US005129327A

United States Patent [19]

Snead

[11] Patent Number: 5,129,327

[45] Date of Patent: Jul. 14, 1992

[54] CONTINUOUS GONDOLA CAR

[76] Inventor: Edwin deS. Snead, P.O. Box 1000, Georgetown, Tex. 78627

[21] Appl. No.: 653,308

[22] Filed: Feb. 11, 1991

[51] Int. Cl.[5] ..... B61D 17/00

[52] U.S. Cl. ..... 105/4.1; 105/458; 105/355

[58] Field of Search ..... 105/3, 4.1, 4.3, 8.1, 105/16, 17, 238.1, 244, 375, 422, 424, 439, 457, 458, 355

[56] References Cited

U.S. PATENT DOCUMENTS

| | | | |
|---|---|---|---|
| 2,793,597 | 5/1957 | Walters | 105/439 |
| 3,093,216 | 6/1963 | Dunham | 105/422 |
| 3,290,058 | 12/1966 | Ellerd | 105/4.1 |
| 3,922,971 | 12/1975 | Maroshick | 105/17 |
| 4,241,665 | 12/1980 | Kleim | 105/8.1 |
| 4,579,063 | 4/1986 | Losa et al. | 105/8.1 |

FOREIGN PATENT DOCUMENTS

| | | | |
|---|---|---|---|
| 898911 | 6/1962 | United Kingdom | 105/458 |

*Primary Examiner*—Douglas C. Butler

*Assistant Examiner*—Kevin D. Rutherford

*Attorney, Agent, or Firm*—Harrison & Egbert

[57] ABSTRACT

A gondola car for use with a train of like gondola cars that comprises a body having a floor and two sidewalls, a bridge extension connected to the floor and extending outwardly beyond the two sidewalls, a wall transition member of arcuate shape extending beyond the end of one of the sidewalls, and a pivotal connector positioned adjacent the bridge extension for enabling pivotal movement between the gondola car and an adjacent gondola car. The wall transition member is fastened to one of the sidewalls and is in sliding rotational relation to a arcuate-shaped guide section on an adjacent gondola car. The bridge extension has a curved edge affixed to the bottom edge of the wall transition member. The curved edge has a radius of curvature generally equal to the radius of curvature of the arcuate-shaped of the wall transition member. The floor has a plurality of apertures for receiving a fixed cleat from a tractor/shovel. The bridge extension has a configuration so as to overlap the floor of an adjacent gondola car.

17 Claims, 8 Drawing Sheets

CONTINUOUS GONDOLA CAR

TECHNICAL FIELD

The present invention relates to material transporting systems. More particularly, the present invention relates to trains having the capability of remote loading and unloading. In addition, the present invention relates to continuous gondola car configurations.

BACKGROUND ART

In the late 1980's, the cost of transporting commodities by rail in the United States was approximately three cents per revenue-ton mile, plus about one dollar per ton as fixed cost. The comparable cost of transportation by motor truck on public highways was approximately eight cents per revenue-ton mile, also plus an additional one dollar per ton as fixed cost.

The carrier's cost is primarily composed of two major direct costs and two major indirect costs. The largest direct cost is labor for the train crew or for the truck driver. In this instance, railroads enjoy about a 50 to 1 advantage over trucks. Trains are capable of enabling five men to transport 10,000 tons of material. On the other hand, a single truck driver can transport only about 25 tons. This is approximately an 80 to 1 benefit relative to labor costs. The second major direct cost is fuel, in which case the railroads can produce three to five times as many revenue-ton miles per gallon or per dollar of fuel as the trucks can produce.

One of the major indirect costs is the investment in the rolling stock. A 10,000 ton load requires at least five locomotives (costing one million dollars each) plus 100 freight cars at approximately forty thousand dollars apiece. This investment amounts to approximately one thousand dollars per ton of capacity. On the other hand, a new truck and trailer for hauling bulk commodities might cost in the range of one hundred thousand dollars for a 25 ton capacity, or about four thousand dollars per ton of capacity. Once again, the railroads show about a 4 to 1 advantage over trucks in this area.

The other major indirect cost is the upkeep o( the roadway. American railroads spend approximately one-half cent per revenue-ton mile for maintenance of way and structures. Trucks running on public roads pay fuel, taxes and registration and use taxes which add up to roughly the same amount.

Based on the foregoing examples, railroads show approximately a 4 to 1 advantage in the cost of rolling equipment, a 4 to 1 advantage in fuel, and a 80 to 1 advantage in operator wages. Based on these numbers, it would seem that railroads should be able to completely dominate the transportation of bulk commodities.

In practice, however, railroads are most suited for hauling very large quantities (e.g. 10,000 tons in a unit train of coal). Whereas, sand, gravel, stone, and other bulk commodities seldom travel in such large quantities to make up a complete maximum train. This means that many shipments must be delayed while waiting for the railroads to assemble less than trainload lots into an economical train. After the material arrives at the destination, it still must be unloaded from the railroad cars and carried to the point of use. In many cases, this involves truck transportation, and in all cases it involves the unloading of railroad cars.

Many systems have been devised for fast unloading of railroad cars. Most of these require expensive facilities costing millions of dollars. Such systems serve to turn the cars upside down or allow the material to be dropped through the track onto conveyer systems. Unfortunately, a large portion of the sand, gravel, and stone moved by railroads travels in open topped gondola cars which must be unloaded by hand or by some type of machinery. Usually, such machinery dips out one bucket at a time and places it on the ground or onto waiting trucks. This is a fairly slow process which also requires a large number of cars to wait while a single machine unloads them at a time.

U.S. Pat. No. 4,958,977, issued on Sept. 25, 1990, entitled "System for the Transport of Bulk Commodities", described an invention which was a predecessor to the present invention. U.S. Pat. No. 4,958,977 describes a continuous gondola car configuration. A tractor-shovel tranverses the length of the train for the purpose of unloading material from the train. Each of the gondola cars in the train is interconnected in an overlapping fashion. A spring-loaded hinged panel covers the gaps between each of the cars. After experimentation, it was found that the hinged panel were unnecessarily complicated and tended to release material through the gaps between the cars. It was determined that a more efficient and effective approach to the overlapping of adjacent gondola cars was necessary.

Various United States patents have shown rather cumbersome methods and apparatus for unloading gondola cars. U.S. Pat. No. 4,099,635, issued on Jul. 11, 1978, to Leonard et al, shows a loader/unloader mechanism that moves along the top edges of adjacent gondola cars. This includes a complex wheeled chassis that engages the top rim of each gondola car. It also includes wheel spanning legs, pivotally mounted to the chassis, which are adapted to span gaps between adjacent cars and support the chassis as it moves along the gaps. A shovel then dips into the gondola cars for loading and unloading.

U.S. Pat. No. 4,128,180, issued on Dec. 5, 1978, to Mellious, shows an apparatus that is adapted for material handling equipment for the purpose of loading and unloading gondola cars. In particular, this invention shows a backhoe that is modified so as to allow the backhoe to travel along the top portions of gondola cars. The modifications of this device comprise the provision of a smooth, solid underplate at the lower extremity of the undercarriage of the material handling equipment item. This underplate extends laterally beyond the undercarriage so as to provide a skid surface upon which the material handling equipment may be supported. Suitable clamps are installed in the outriggers of the material handling equipment for engaging the sidewalls of an open top container. The backhoe/-shovel is slowly moved from gondola car to gondola car by a complex procedure.

U.S. Pat. No. 4,723,886, issued on Feb. 9, 1988, to L. E. Frederking, shows another type of apparatus for loading and unloading gondola cars. This device utilizes tracks that extend along the top edge of the gondola car so that a hydraulic excavator may dip into the gondola car so as to extract material. These tracks are adapted to be placed upon the top of an open top railroad car or gondola car. Each of the tracks has a lip at the outer edge which extends downwardly outside the upper surface of the parallel sidewalls of the railroad gondola car so as to prevent the hydraulic excavator from falling off the gondola car when the two tracks are resting on the sidewalls of the gondola car. In this device, as with the previous top-mounted shovel arrangements, a great deal of leverage is required for the loading/unloading operation of these tractor/shovel systems. Many of these devices require external lines so as to fix the devices in place.

Because most railroad shipments are less than a unit train load, their arrival cannot be predicted with any degree of certainty. As a result, loaded cars must frequently wait several days to be unloaded. Because of these and other problems, the average United States railcar makes only about one revenue trip per month, whereas the average truck makes several revenue trips per week, and on short hauls may even make five or six revenue trips per day.

As a result, one of the major indirect advantages of rail transportation is totally eliminated and reversed. That is, rather than having a 4 to 1 advantage in the investment of rolling stock per ton of capacity, under present methods, the railroads suffer at least a 4 to 1 disadvantage in this factor.

The present invention serves to eliminate the major disadvantage of rail transportation by allowing small shipments to be unloaded immediately upon arrival. This enables the whole assembly of locomotive and cars to make a revenue trip every day or even more on very short hauls.

The use of gondola cars having a continuous trough extending throughout the cars would be one solution to the problem. Such a continuous load-carrying car would enable a vehicle to traverse the interior of the train while unloading the train.

U.S. Pat. No. 4,754,710, issued on Jul. 5, 1988, to K. C. Kieres describes a railway car for carrying freight. In particular, this patent describes the use of a continuous railway car having one continuous trough. The trough is supported at each end wall by trucks. The sidewalls are made up of a plurality of side panels. The side panels have overlapping systems to permit relative motion between adjacent panels for maneuvering curves and hills. The floor has a plurality of laterally and longitudinally extending slope sheets. A flexible center sill extends continuously for the entire length of the railway car.

A difficult problem in the construction of a continuous gondola car has been the arrangement of the walls between adjacent gondola cars. Since the gondola cars will traverse curved sections of track, a great deal of flexibility must be built into the walls in the area of connection between adjacent gondola cars. Although the walls must be flexible, they must also be capable of retaining the material within the gondola car configuration. Furthermore, when the aggregate material is severely compacted within the continuous gondola car configuration, this area of connection becomes a more serious concern. Severe compaction of material within the continuous gondola car could lead to the derailing of, or structural damage to, the continuous gondola car. It is very important that these junction walls be designed in a proper manner so as to accommodate the occurrence of severe compaction. Prior art systems have either failed to address this problem, or have adopted inadequate solutions.

U.S. Pat. No. 2,052,867, issued on Sep. 1, 1936, to R. E. Cartzdafner et al., describes one technique of providing a continuous floor in an open top railroad car. When the train is in operation, the floor between adjacent cars is raised into proper position perpendicular to the floor of the individual railroad cars. When it is necessary to unload the car, the floor is lowered so as to create a continuous passageway between adjacent railroad cars. This patent, however, does not attempt to close the gap along the sidewalls of the train.

U.S. Pat. No. 2,839,010, issued Jun. 17, 1958, to H. J. Harbulak, describes an articulated conveyor train. This device provides articulation between adjacent open top cars. In addition, this provides a solution for the problem of traversing the corners. However, and very importantly, the Harbulak patent, does not address the use of a continuous flat surface at the bottom of the cars. The Harbulak patent utilizes a raised junction that incorporates a rather complex spring-tension system. The Harbulak patent would be unsuitable for the passage of a shovel therethrough.

U.S. Pat. No. 2,793,597, issued on May 28, 1957, to W. R. Walters, describes an articulated connection between railway cars. This patent offers a novel approach in which a flat surface is disposed between adjacent sidewalls on railway cars. A slot is formed at the end of the sidewalls of each railway car. A flat plate will fit and slide freely within the slots. This plate extends between the adjacent railway cars. Although this apparatus presents a desirable solution to the problem of material escaping between the adjacent cars, it is particularly inappropriate for use on curves. Although Walters uses a center strip that will flex and yield on sharp turns, such a center strip would not be appropriate where severe compaction occurs. This center strip would require flexing into the material contained within the gondola cars. Under conditions of severe compaction, the material would resist such flexure. As a result, damage to the slots would result, or, the potential for derailment would be great.

It is an object of the present invention to provide a system for the unloading of gondola cars so as to allow such cars to be loaded and unloaded at a remote location.

It is another object of the present invention to provide a continuous gondola car that enables conventional tractor/shovel configurations to be utilized for the unloading and loading of such gondola cars.

It is another object of the present invention to provide a continuous gondola car configuration that allows such gondola cars to be utilized along the sharpest of turns.

It is another object of the present invention to provide a continuous gondola car that uses a junction between adjacent gondola car that minimizes hazards of structural damage or derailment to such gondola cars.

It is still a further object of the present invention to provide a continuous gondola cars configuration that allows rotation between adjacent gondola cars while minimizing material loss.

It is another object of the present invention to provide a loading and unloading gondola car system that enables a tractor/shovel to have sufficient leverage for effective material unloading.

It is another object of the present invention to provide an unloading system that maximizes economies and capacities while minimizing expense, complexity, and capital and labor investment.

These and other objects and advantages of the present invention will become apparent from a reading of the attached specification and appended claims.

SUMMARY OF THE INVENTION

The present invention, in its broadest embodiment, is a material transport system that comprises a material container for receiving material to be transported, motive power connected to the material container for allowing the material container to move from one place to another, and an unloader positioned within the material container for unloading material. The material container is generally a flat long floor extending between a pair of sidewalls. The unloader is made up of a tractor/-shovel extending between the sidewalls of the material container. The tractor serves to selectively move the shovel longitudinally along the floor. The shovel has a size suitable for fitting between the sidewalls of the material container. The shovel passes material from between the sidewalls to a location external of the material container. Alternatively, the shovel can be used to load material from a position exterior of the material transport system of the present invention into the material container.

In more specific embodiments, the material container comprises a plurality of gondola cars having a generally flat floor extending throughout. Each of the plurality of gondola cars is pivotally connected to an adjacent car. The floor of one gondola car will include a bridge extension that overlaps a portion of the floor of an adjacent car. The overlapping of floors is in the same direction throughout the length of the roadway throughout the gondola cars. In addition, each of the railroad cars has a wall transition member of arcuate shape that extends beyond the end of the one of the sidewalls. This wall transmission member is an arcuate-shaped panel that is fastened to one of the sidewalls. A guide portion, of similar radius, is formed in the adjacent sidewall on the adjacent gondola car. Upon the movement of the gondola car train of the present invention throughout a curved section of track, the arcuate-shaped wall transition member will move in sliding rotational relationship relative to the arcuate-shaped guide section in an adjacent sidewall. It is preferable that the wall transition member be closely aligned with the curved guide portion of an adjacent gondola car. This relationship of the curved wall transition panels allows the retention of material within the gondola car while preventing derailment or other structural deformation caused by the movement of the train through curved sections of tracks.

The railroad cars are permanently coupled by pivotal connection points. Ideally, the overlapping portion of the bridge extension will be pivotally connected to the floor of an adjacent gondola car. The frame of the gondola car is structured so that a pivotal connection point is established. As a result, the radius of curvature of the the wall transition members will be equal to the distance between the pivot point and the wall of the gondola car. The bridge extension portion will also include curved outer edges that conform to the curvature of the wall transition panels. The wall transition panel is fixedly connected to this curved portion of the bridge extension. As such, material is securely retained within the roadway of the gondola cars throughout the travel of the gondola car.

The motive power for the present invention is provided by suitable railroad trucks attached at the area of the articulated connection of adjacent pairs of gondola cars.

The floor of the material container is in frictional relationship with the tractor of the unloader. Specifically, the floor has a plurality of openings formed therein. A plurality of cleats are fastened to the crawler of the tractor. These cleats will have a shape that is suitable for insertion within these cleat-receiving apertures formed in the floor. These cleat-receiving apertures engage the cleats of the crawler of the tractor during the longitudinal movement of the unloader throughout the roadway of the material container. A suitable covering is affixed on the lower side of these apertures so as to keep material from falling through these cleat-receiving apertures. As the cleat of the tractor enters into the opening, the aggregate, or other material, is forced from this aperture into the roadway.

The unloader also includes a turntable that is rotatably mounted to the tractor. The shovel is in articulated connection to this turntable. This turntable enables the shovel to be rotated away from the floor for the purpose of loading or unloading. As an alternative, the unloader may also include an auger rotatably mounted within the shovel. This auger moves material toward the center of the shovel. A conveyer is then arranged adjacent to the center of the shovel. The conveyer moves the material away from the auger to a location external of the material container.

It is important to note, in its broadest embodiment, the present invention should not be limited to trains or train systems. It is also possible that the present invention is applicable, useful, and important in the unloading of other material transport vehicles, such as barges.

BRIEF DESCRIPTION OF THE DRAWINGS

FIG. 4 shows the wall transition member and bridge extension of the present invention.

DETAILED DESCRIPTION OF THE INVENTION

Figure 1:
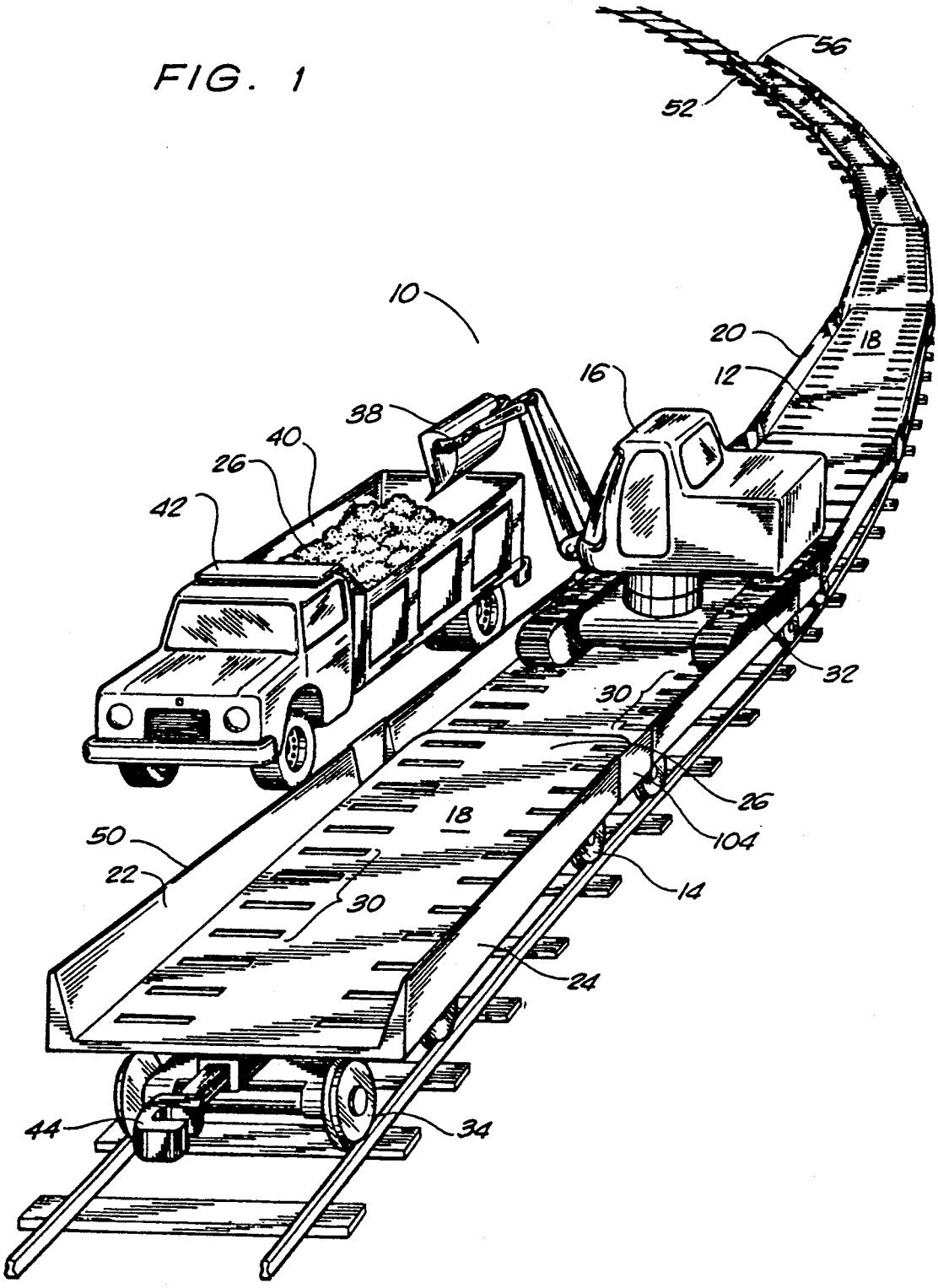
FIG. 1 is a perspective view of the material transport system in accordance with the present invention.

Referring to FIG. 1, there is shown at 10, the material transport system in accordance with the preferred embodiment of the present invention. In the material transport system 10, there is shown the material container 12, the motive members 14, and the unloader 16. Importantly, although the material transport system 10 is of a continuous gondola car configuration, this is not intended to limit the scope of the present invention. The scope of the present invention may be applicable to many other material transport arrangements and suitable for the unloading of barges, trucks, and various types of railroad cars other than gondola cars.

The material container 12 receives the material to be transported. Material container 12 has a generally flat floor 18 that extends for the length of the train 20 between continuous sidewalls 22 and 24.

The material container 12 is, in general, a plurality of gondola cars 20 having a generally flat roadway 18 extending throughout. Each of the gondola cars 20 is pivotally connected to an adjacent gondola car. As can be seen in FIG. 1, each of the railroad cars has a bridge extension 26 that overlaps a portion of the floor of an adjacent gondola car 20. Throughout the train, this bridge extension 26 overlaps in the same direction. The purpose for this unloading is to allow the shovel of the unloader 16 to traverse the length of the train 20 without encountering a protruding overlap.

A plurality of cleat-receiving apertures 30 are formed transversely in floor 18 of railroad cars 20. These apertures 30 engage a cleat fastened to the crawler of tractor 32 of unloader 16.

Figure 2:
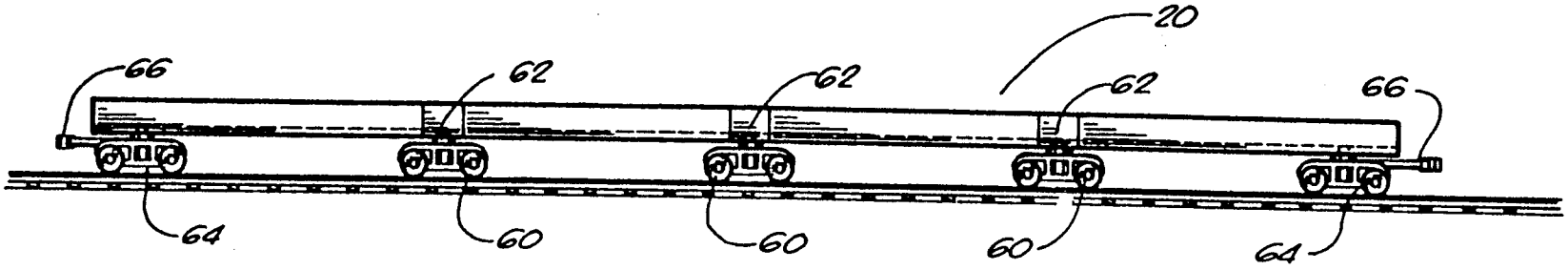
FIG. 2 is a diagrammatic side view of the continuous gondola car configuration of the present invention.

The motive members 14 comprise railroad trucks 30 that are attached to the train at the articulated connection of adjacent pairs of the railroad cars 20. A more detailed view of this is shown in FIG. 2, to be described hereinafter.

The unloader 16 comprises a tractor that extends between the sidewalls 22 and 24 of material container 12. The tractor 32 selectively moves the unloader 16 longitudinally along the floor 18 of train 20. A shovel 38 is articulated to the tractor 32. The shovel 38 has a size suitable for fitting closely between the sidewalls 22 of train 20. The shovel 38 passes material from between the sidewalls to locations external of the material container 12. Alternatively, the shovel 38 may be used to load material from an area external of the material container 12 to the area between the sidewalls 22 of the train of the present invention. As shown in FIG. 1, shovel 38 receives the material from the floor 18 and passes such material into the bed 40 of dump truck 42. In keeping with the present invention, shovel 38 could also deposit the material 26 at any other location alongside train 20.

Train 20 includes standard couplings 44 at the end of the train so as to allow the train 20 to be coupled to other cars or to locomotives.

Relative to the specific details of the preferred embodiment, the train 20 is made up of twenty permanently coupled units having a capacity of approximately fifty net tons each. The cars 50 and 52 at the end of the train 20 are equipped with standard trucks and couplings. These end units 50 and 52 have a nominal capacity of seventy-five tons, as compared to the fifty ton capacity for the intermediate units. In a one thousand ton train, the two end units 50 and 52 have a capacity of one hundred and fifty tons, while the remaining eight hundred and fifty tons are distributed throughout the remaining cars. An entire one thousand net ton train 20 could be supported by twenty trucks.

Although it is not shown in FIG. 1, train 20 may have an end gate at end 56. This is the end where the unloading device finishes the unloading of the train. The end gate 56 may be lowered so as to rest on standard couplings between two adjacent continuous gondola car trains so as to allow the unloading device to travel from one train set of such gondola cars to another train set. At the end 58, there is no end gate. It is possible that a folding ramp may be incorporated into end 58 so as to allow the unloader 16 to crawl up and down in order to get into and out of the car 50.

FIG. 2 shows a side view of train 20 and the configuration of the gondola cars. As can be seen in FIG. 2, the two axle railroad trucks 60 are positioned at the pivotal connection 62 of adjacent gondola cars. It can be also seen in FIG. 2 that the trucks 64 are mounted in conventional fashion at the end of train 20. A standard coupling 66 extends at each of the ends of train 20.

Figure 3:
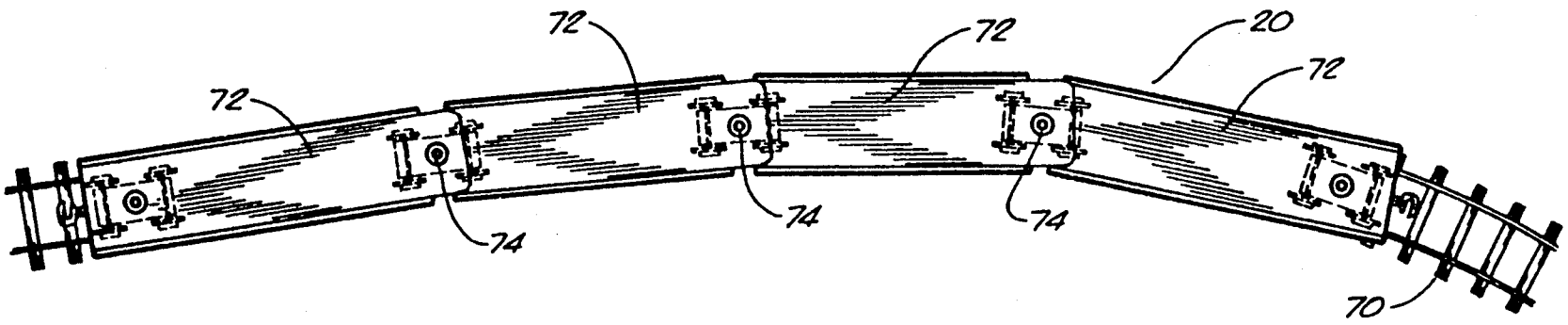
FIG. 3 is a top view of the continuous gondola car configuration of the present invention.

FIG. 3 is a top view showing the ability of the continuous gondola car train 20 of the present invention to traverse tight sections of curved track 70. In the view of FIG. 3, the entire train has one continuous floor 72 made up of bridge extensions which overlap the region of the articulated couplings 74. This allows the floor of one unit to slide over the floor of an adjacent unit as the train 20 negotiates curve 70. In one specific model of the train, having approximately 33⅓ feet between couplings 74, it was shown that the train could negotiate a twenty-seven degree per one hundred foot curve. This is a sharper curve then can be found in nearly any system in the United States. In negotiating this curve, the maximum angle between adjacent units 72 is nine degrees.

Figure 4:
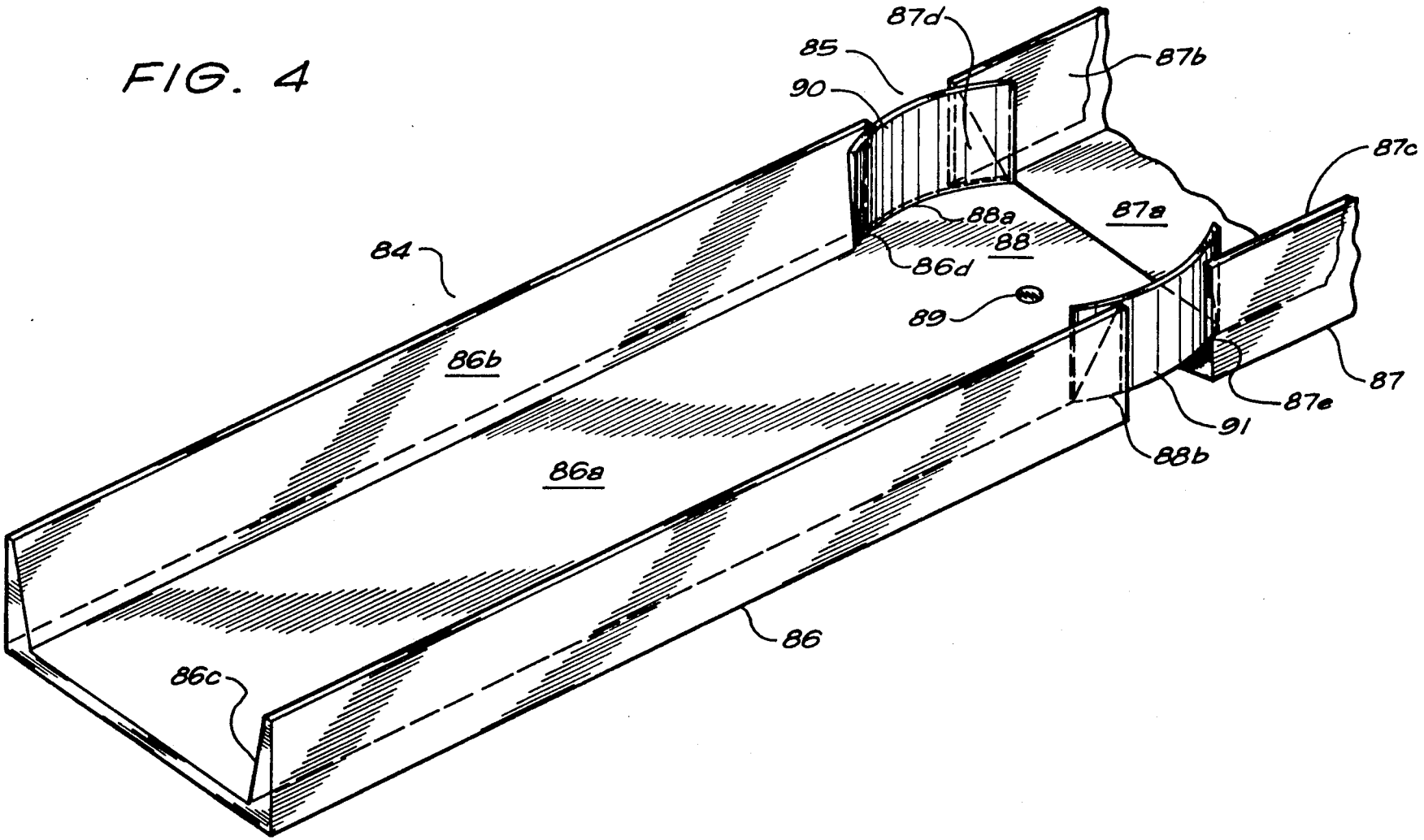
FIG. 4 is a perspective view showing the configuration of an individual gondola car as connected to an adjacent gondola car. Specifically.

FIG. 4 is a perspective view showing the configuration of a pair of gondola cars. FIG. 4 also shows the pivotal connection arrangement 85 formed in the transition area between car 86 and car 87. It can be seen that first gondola car 86 includes floor **86*a*, first sidewall 86*b*, and second sidewall 86*c*. Sidewalls 86*b* and 86*c* are permanently affixed to the floor 86*a*. Second gondola car 87 includes floor 87*a*, first sidewall 87*b*, and second sidewall 87*c*. In a configuration quite similar to that of the first gondola car 86, the second gondola car 87 also has the sidewalls 87*b* and 87*c* permanently affixed to floor 87*a***.

Bridge extension 88 is formed so as to be integral with floor **86*a*. This bridge extension 88 extends from the floor 86*a* of the first gondola car 86 so as to overlap the floor 87*a* of the second gondola car 87. There exists a pivotal connection point 89 between the bridge extension 88 and the floor 87*a*. Pivotal connection point 89 is the point in which the second gondola car 87 rotates relative to the first gondola car 86**.

FIG. 4 also shows an important feature of the present invention, namely, the wall transition members 90 and 91. Wall transition member 90 extends from the first sidewall **86*b* of the first gondola car 86 to the first sidewall 87*b* of the second gondola car 87. Wall transition member 91 extends from the second sidewall 86*c* of the first gondola car 86 to the second sidewall 87*c* of the second gondola car 87. As illustrated in FIG. 4, these wall transition members 90 and 91 are in sliding rotational relationship with their respective sidewalls. The wall extension members 90 and 91 are of arcuate shape. These arcuate-shaped wall transition members 90 and 91 are fixedly mounted, by welding or other means, to one of the sidewalls. In the preferred embodiment of the present invention, these wall transition members 90 and 91 are rigidly affixed to the sidewalls 86*b* and 86*c*, respectively, of gondola car 86. However, alternatively, these wall transition members 90 and 91 could be affixed to the sidewalls 87*b* and 87*c* of second gondola car 87**. Still further, and alternatively, each of these wall transition members could be affixed to different walls on different gondola cars.

Sidewall 86 includes a partially curved portion 86*b* that receives a portion of the wall transition member 90. The curvature of section 86*d* should match that of the curvature of the wall transition member 90. Another curved portion of wall 86*c* occurs in the location of the second wall transition member 91. It can be seen that the wall transition members 90 and 91 span the gap between the first sidewalls 86*b* and 87*b* and the gap between the second sidewalls 86*c* and 87*c*. By covering this gap, the arcuate-shaped wall transition members 90 and 91 prevent material from spilling outwardly from the interior of gondola cars 86 and 87.

On gondola car 87, there are curved guide sections 87*b* and 87*e*. Guide sections 87*d* and 87*e* should have a radius of curvature similar to that of the transition members 90 and 91. As the gondola cars 86 and 87 rotate about pivot point 89, in relation to each other, the curved transition walls 90 and 91 will move along guide portions 87*d* and 87*e*. The curvature of these walls 87*d* and 87*e* allows the curved transition walls 90 and 91 to move freely and with a minimum of resistance from the load contained within the gondola cars 86 and 87. In the preferred embodiment of the present invention, the transition walls 90 and 91 will slide, as closely as possible, to the curved guide sections 87*d* and 87*e*.

The bridge extension 88 includes rounded edges 88*a* and 88*b*. The transition walls 90 and 91 are rigidly affixed to rounded edges 88*a* and 88*b*, respectively. The rounded edges 88*a* and 88*b* will also have a radius of curvature that matches the radius of curvature of guide sections 87*d* and 87*e* so as to allow proper rotation between the gondola cars 86 and 87.

It can also be seen in FIG. 4 that the walls 86*b* and 86*c* have an angle from the vertical of more than fifteen degrees. This angled loading configuration allows the material to properly drift toward the bottom of the gondola car 86. Additionally, this enhances the ability unload the gondola car.

Figure 5:
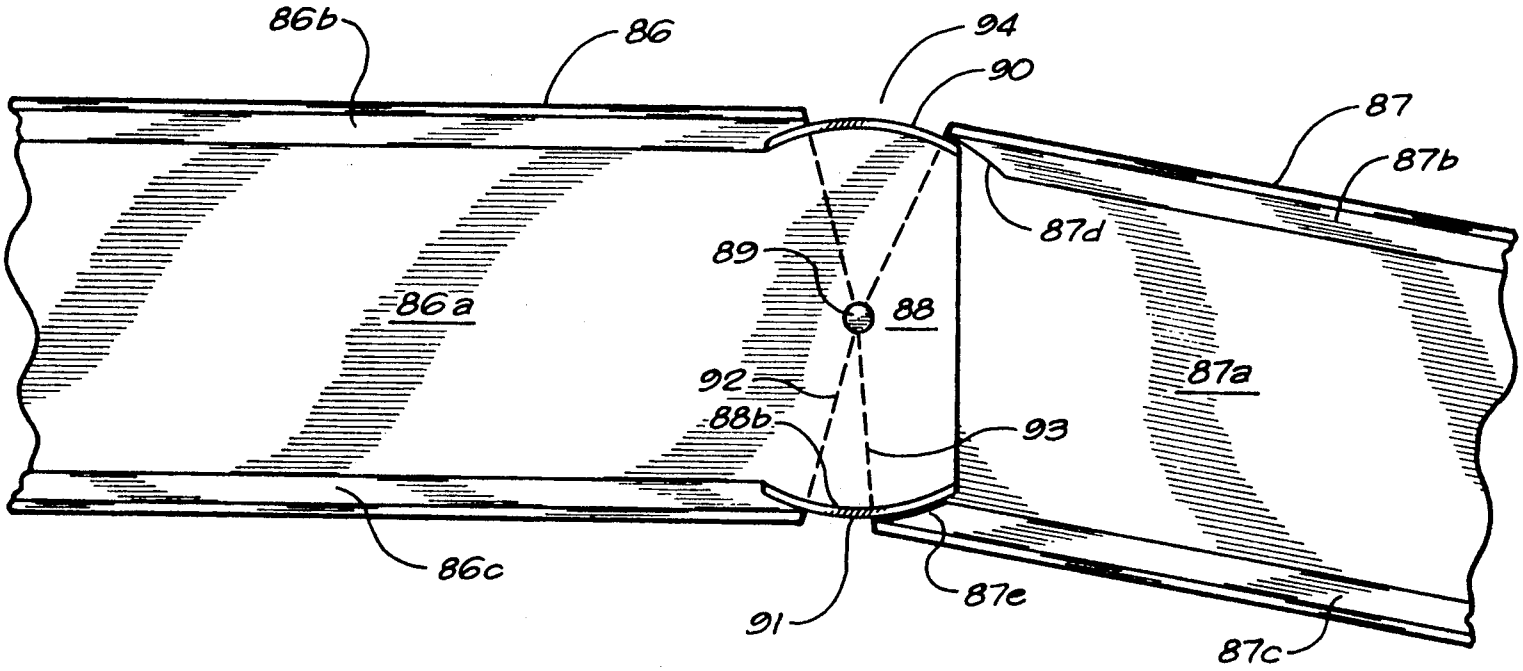
FIG. 5 is a top view showing the movement of the wall transition members and bridge extension during travel along a curved section of track.

FIG. 5 is a top view of the configuration of FIG. 4 showing the gondola cars 86 and 87 as in position when traversing a curved section of track. The relatively prismatic undercarriages 92 and 93 of gondola cars 86 and 87, respectively, are illustrated. These prismatic undercarriages 92 and 93 are precisely shaped so as to allow pivotal movement relative to pivotal connection point 89. The amount of angling of these prismatic undercarriages 92 and 93 is designed to prevent abutment between the flat surfaces. As the track becomes more curved, the walls of these undercarriages 92 and 93 will move closer together on one side. For the integrity of the present invention, it is important that these be designed so that they do not ever encounter track that would create abutment between the surfaces.

These undercarriages 92 and 93 also illustrate the movement of the separate gondola cars 86 and 87 around this track. As the train traverses a curved section of track, the wall 86*b* of gondola car 86 will move farther from wall 87*b* of gondola car 87. As such, the gap 94 between the sides of these cars 86 and 87 will become greater. To accommodate this gap, the wall transition member 90 will move into the relative position showing in FIG. 5. As such, the area of this gap remains closed. The walls 86*c* and 87*c* will move closer together during the traversing of such curved track. When this occurs, the transitional wall 91 will move along the curved guide section 87*e* of wall 87*c* of gondola car 87. This also maintains the effective seal within the interior of the gondola car train. Similarly, the bridge extension 88 will rotate within these guide portions 87*d* and 87*e*.

The configuration shown in FIGS. 4 and 5, particularly, the transition area, is an important consideration of the present invention. One of the problems with continuous train systems is the risk of derailment when large amounts of compacted material resist the natural movement of the train. Any type of connection system that works so as to cause a reduction in the area available for the contained material will create potential derailment problems. When connection systems include the collapsing of walls, or accordion-like movement of walls, then the compacted material contained within the gondola cars will resist such compression. As a result, the structure of the train itself will have to accommodate this resistance, or the train will derail. It has been found with the present invention that this rotational system continuously maintains the same material volume during the transition through curves. Furthermore, the edges of the transition wall members 90 and 91 tend to break up compacted material so as to enhance the ability to approach curves. Tests of this configuration have shown that the transition section functions properly even with extreme high-density compacted material.

Figure 6:
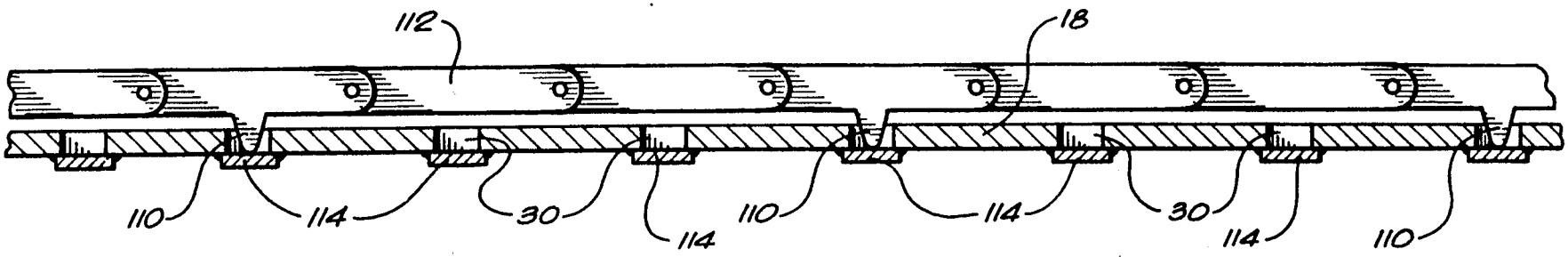
FIG. 6 is a side view showing the relationship between the cleats of the crawler and the cleat-receiving apertures in the floor of the continuous gondola car.

FIG. 6 shows, in detail, the arrangement of the cleat-receiving apertures 30 relative to the floor 18 of the gondola cars 20. In addition, FIG. 6 shows the relationship of the cleats 110 with the apertures 30. With reference to FIG. 1, the tractor 32 has crawlers 112 mounted thereon. Crawlers 112 allow the unloader 16 to move along the train 20. Crawlers 112 have a plurality of cleats 110 that are affixed to the crawlers and extend thereacross. The apertures 30 are formed within the floor 18 so as to allow appropriate traction during the lifting and unloading phase of unloader 16. The spacing of the apertures 30 should match the spacing of the cleats 110 that are attached to crawler 112. During normal operation of the unloader 16, the cleats 110 will drop into slots 30. If the unloader 16 were equipped with a rubber-tired undercarriage, then there could be enough friction between the tires and the floor 18 of the cars 20 so as to provide the friction necessary to pick up load 26. However, for track-mounted equipment, such as that shown in FIGS. 1 and 6, the friction between the steel crawlers 112 and the steel floor 18 would not be sufficient for proper unloading. To accommodate this difficulty, the apertures 30 are provided in floor 18. These apertures are cut into the steel floor 18 (having a thickness of approximately one-half inch). The resulting holes in the floor are covered by welding steel plates 114 onto the bottom of each of the apertures 30. These steel plates 114 cover the bottom of the apertures 30 so as to prevent material from passing therethrough.

In use, the cleat 110 on the crawlers 112 of unloader 16 fit into the apertures 30. This should provide more than enough traction for the thrust required to crowd the bucket into the pile of material being unloaded. By analogy, this is done in a manner similar to a rack-and-pinion system. The rack is provided by the special bottom of cars 20 and the pinion is the crawlers 112 and their attached cleats 110.

To prevent the shovel 38 from catching in the apertures 30, the outboard end of the apertures is a substantial distance (several inches) away from the bottom edge of the sidewall. As a result, the shovel is wider than the overall width of the pair of slots and would fit very closely into the car itself. The bucket of shovel 38 then slides smoothly over the surface 118 of floor 18. During use, the shovel is supported at all times in three places, that is, the outboard edges and the center.

After unloading, the only material left in the car would be the volume left in the apertures 30. The material in the apertures 30 is crushed by the cleats 110. It is estimated that such material adds up to less than thirty pounds per unit. This remaining material can easily be picked up by an industrial vacuum cleaner or otherwise removed from train 20. Because of the weight of the tractor/shovel, any material that resides in an aperture 30 during the movement of the crawler 112 will be pushed from the aperture 30 when the cleat engages such aperture.

Figure 7:
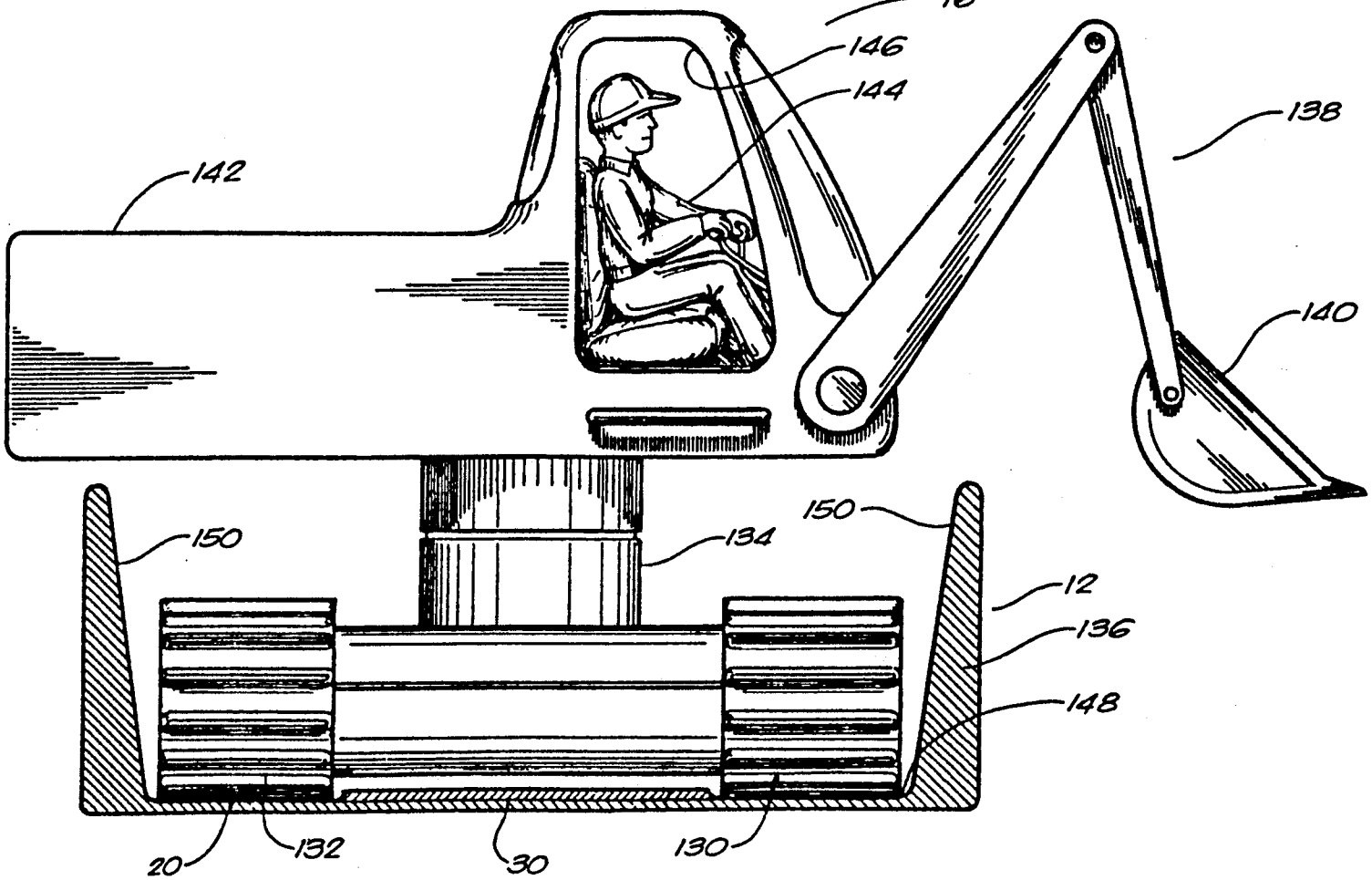
FIG. 7 is an end view showing the position of the tractor/shovel within the material container.

FIG. 7 shows the arrangement of the unloader 16 within the material container 12. As shown in FIG. 7, the material container can be a container other than a gondola car. It can be seen that shovel 16 is a piece of earth-moving equipment. Unloader 16 is a tractor shovel which is mounted on crawlers 130 and 132. The upper body of unloader 16 is mounted on turntable 134. Turntable 134 allows the device to pick up a bucketload full of material and lift it over the sidewalls 136 of the gondola car. Turntable 134 allows the shovel 138 to be turned ninety degrees or more. Following the turning, the bucket 140 of shovel 138 may discharge the material onto the ground or onto a waiting truck. Unloader 16 has a counterweight 142 at its rearward end so as to balance the load contained within bucket 140 of shovel 138. The operator 144 sits within a compartment 146 on the unloader 16. Unloader 16 resembles a Caterpillar Model No. 215 or No. 225 tractor shovel. It has been found that this type of unloader is satisfactory for these purposes.

In the view of FIG. 7, it can be seen that the interior sidewalls 150 are angled inwardly so that the load within the material container 12 is encouraged to pass to floor 148. Floor 30 supports these walls 150. The apertures 30 are shown in FIG. 7 in a proper position for receiving the cleats on the crawlers 130 and 132.

Figure 8:
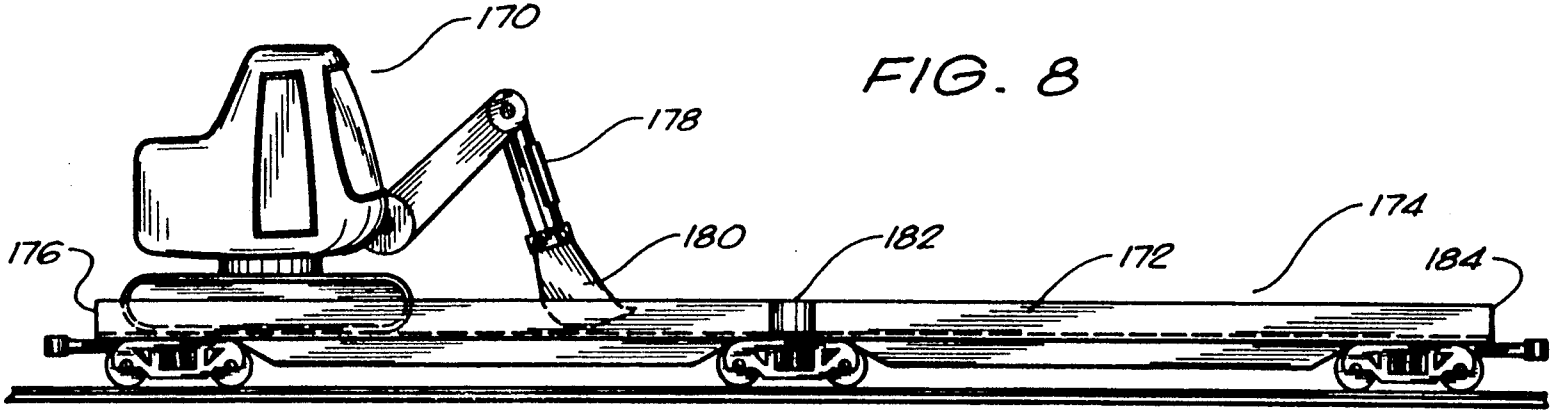
FIG. 8 is a side view showing the positioning of the tractor/shovel in an empty gondola car configuration.

FIG. 8 is a diagrammatic illustration showing the inclusion of the unloader 170 within the interior 172 of the gondola car configuration 174 of the present invention. In FIG. 8, the configuration of the present invention is illustrated with no material contained within the gondola cars 174. During transport sequences where it is desirable for the gondola car train 174 to be transported to an area for the loading of material, the unloader 170 may be positioned at the rearwood area 176 of train 174. In this configuration, the train 174 can be transported to the desired location for loading. Because of the long shovel arm 178 of unloader 170, the bucket 180 may receive material from a location external the train 174. As new bucket loads are received by the train 174, the bucket 180 will load material into the interior 172 of train 174. When the loading sequence occurs, it is necessary for the unloader 170 to move rearwardly as the material is being unloaded into the interior 172. In normal transportation operations, there will be a load of approximately 64,300 pounds at end 176 of train 174. In the transition section 182, there will be a load of approximately 43,100 pounds. Finally, in the end 184, the unloaded train 174 of FIG. 8 will have a load of approximately 31,300 pounds.

Figure 9:
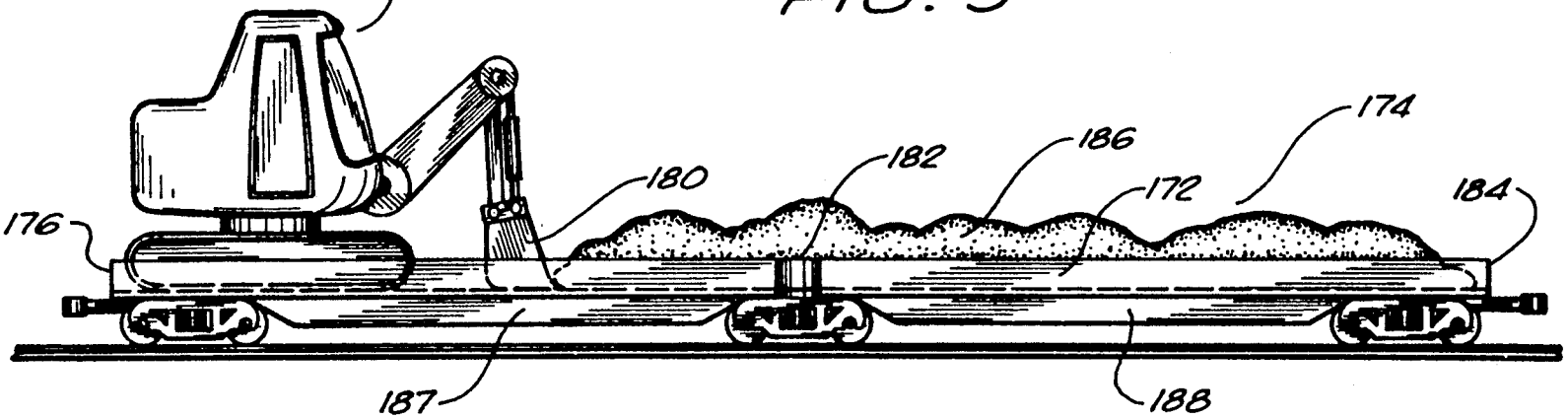
FIG. 9 shows the positioning of the tractor/shovel in a loaded gondola car configuration.

FIG. 9 illustrates train 174 after full loading. Train 174 has a load of aggregate 186 filling the interior 172 of each of the gondola cars 187 and 188. The unloader 170 remains in its proper position at the rearward part 176 of train 174. To unload this material, the unloader 170 will simply scoop the material 186 with bucket 180 until the material has been removed from train 174 and placed in a location external of train 174. In normal operations, end 176 will support a load of approximately 92,400 pounds. The fully loaded train will have a weight at the transition area 182 of approximately 187,900 pounds. At the other end 184, the load carried by gondola train 174 will be approximately 112,900 pounds.

Figure 10:
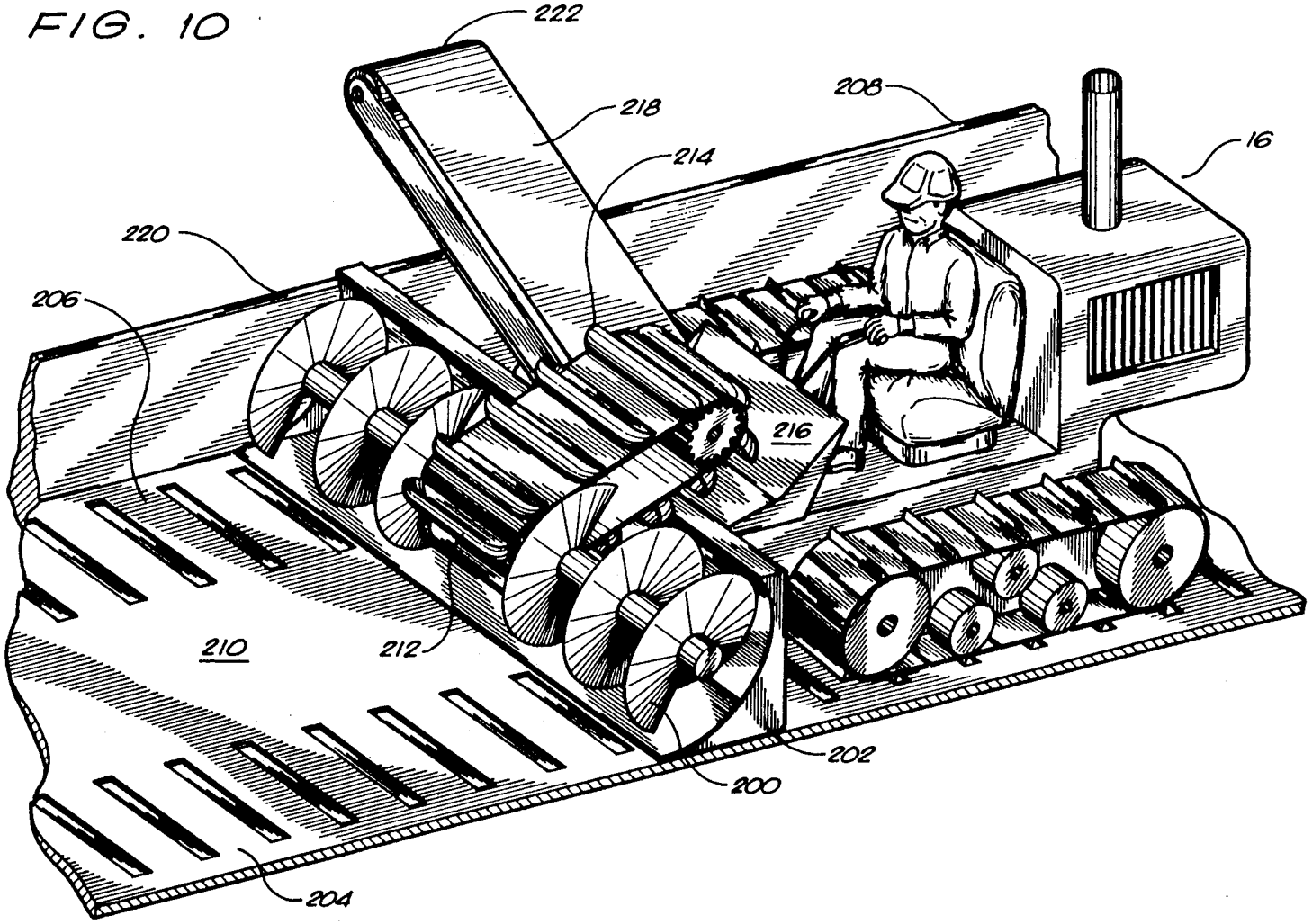
FIG. 10 illustrates an alternative embodiment of the unloading system of the present invention.

FIG. 10 shows another type of unloader 16. Unloader 16 has an auger 200 that is rotatably mounted within shovel 202. The auger 200 operates on the front of shovel 202 so as to collect materials from the sides 204 and 206 of car 208. During the longitudinal movement of the unloader 16 along floor 210 of car 208, the auger 200 moves the material to the center 212 of shovel 202. When the material reaches the center of shovel 202, the material is picked up by a bucket conveyer 214. Once the material is elevated by the bucket conveyer 214, it is dumped into and through hopper 216. The material then passes to conveyer belt 218 which carries the material over the side 220 of car 208. After the material discharges from end 222 of conveyer belt 218, it is deposited on the ground or into a waiting truck. The unloader 16 shown in FIG. 8 is somewhat similar to a device manufactured by the Athey Company. This device has been used successfully for this type of application. Unloader 16 can unload the gondola car configuration by moving along the floor 210 throughout the length of the continuous gondola car configuration. The shovel 202, as seen in FIG. 8, has a width that is nearly identical to the width of floor 210 between walls 204 and 206.

The operation of the present invention can best be described with reference to FIG. 1. Initially, the unloader (tractor/shovel) 16 is placed into end 58 of train 12. Once the unloader 16 is placed onto the end 58, the bottom of shovel 38 is juxtaposed against floor 18. The unloader is then actuated so that the shovel 38 receives material 26 contained within the gondola cars of train 20. The shovel 16 is then moved along its tracks 32 longitudinally within and along floor 18. As the unloader moves through the length of train 20, the shovel 38 receives material 26 until the shovel 38 is filled. The bucket 38 is then lifted from the floor 18 until the bucket is in a position above the top of sidewalls 22 and 24 of train 20. The unloader 16 then rotates so that the bucket 38 extends outwardly beyond the sidewalls 22 and 24. The material 26 is then discharged on the exterior of train 20. The material may also be discharged onto a dump truck 42.

After the unloader 16 traverses the entire length of the gondola car arrangement 20, the unloader 16 backs out to the end where it entered and moves into the next continuous gondola train. The unloader may then wait for the next arrival of the continuous gondola car configuration or it may be loaded for transport elsewhere. The unloader 16 could travel with the train for short trips or for shipments requiring only a few car loads. For bigger shipments, unloader 16 could crawl out of the empty car and wait for another loaded car to be brought in by the next train. In either case, the train can be unloaded immediately upon arrival, and within an hour or two, be on its way back empty for another load.

The present invention achieves a number of advantages not found by prior art systems. Unlike prior art systems, no cables, strands, or other mechanisms are required to provide the necessary leverage for the unloading or loading of the train. If leverage and friction are required, then the apertures of the floor provide suitable friction for the unloading operation. This friction is important for allowing the maximum loads to be removed during the unloading process. This greatly enhances the efficiency and expediency of the unloading process.

Since the present invention utilizes a rather standard tractor shovel, the unloading device should be readily available. Many facilities have comparable devices, thus eliminating the need to haul the unloader with the train. Alternatively, the unloader can be brought to the site and utilized when required This allows the present invention to be adaptable to a wide variety of transport requirements.

In comparison with prior art systems, the present invention does not require the sophisticated operation of crawling along the top edges of the gondola car with a large unloader apparatus. Additionally, a much higher percentage of the material within the gondola cars can be removed than with prior unloading systems. As a result, the present invention achieves advantages in manpower savings, cost savings, scheduling abilities, material delivery, and ease of use that are not found in any prior art systems.

The foregoing disclosure and description of the invention is illustrative and explanatory thereof. Various changes in the details of the illustrated construction may be made within the scope of the appended claims without departing from the true spirit of the invention. The present invention should be limited by the following claims and their legal equivalents.

I claim:

1. A gondola car for use with a train of like gondola cars comprising:

a body having a floor and two sidewalls, said floor extending between said sidewalls so as to define a central runway in said body;

a bridge extension connected to said floor extending outwardly beyond an end of said floor between said two sidewalls;

a wall transition member of arcuate shape extending beyond the end of the floor and extending upwardly generally perpendicular to the floor, said wall transition member fastened to at least one of said sidewalls, said wall transition member being clear from said central runway; and pivotal connection means positioned adjacent said bridge extension for enabling pivotal movement of said body relative to an adjacent gondola car.

2. The gondola car of claim 1, said bridge extension having a rounded edge adjacent said wall transition member, said bridge extension having a width greater than a width of said central runway.

3. The gondola car of claim 2, said rounded edge having a radius of curvature generally equal to the radius of curvature of said arcuate shape of said wall transition member.

4. The gondola car of claim 1, at least one of said sidewalls having a curved surface of a radius similar to the radius of curvature of said wall transition member.

5. The gondola car of claim 4, said sidewalls in sliding contact with the outer surface of said wall transition member.

6. The gondola car of claim 1, said floor having a plurality of cleat-receiving apertures extending through the surface of said floor.

7. The gondola car of claim 6, said cleat-receiving apertures having a cover fastened across said apertures on the underside of said floor.

8. A gondola car pair for use on a train having like gondola car pairs comprising:

a first gondola car having a floor, a first sidewall and a second sidewall, said first and second sidewalls affixed to and extending generally perpendicularly upwardly from said floor, said first and second sidewalls defining a central runway along said floor;

a second gondola car having a floor, a first sidewall, and a second sidewall, said first and second sidewalls affixed to and extending generally perpendicularly upwardly from said floor, said first and second sidewalls further defining said central runway along said floor;

a bridge extension extending from said floor of said first gondola car so as to overlap said floor of said second gondola car; and arcuate-shaped panel means extending from said first sidewall of said first gondola car to said first sidewall of said second gondola car, said arcuate-shaped panel means extending from said second sidewall of said first gondola car to said second sidewall of said second gondola car, said arcuate-shaped panel means in sliding rotational relationship with said sidewalls, said arcuate-shaped panel means being clear of said central runway throughout a range of movement of said first gondola car with respect to said second gondola car.

9. The gondola car of claim 8, further comprising:

pivotal connection means on said first and second gondola cars, said pivotal connection means for connecting said first and second gondola cars together.

10. The gondola car pairs of claim 9, said bridge extension integral with said floor of said first gondola car, said bridge extension pivotally connected to said floor of said second gondola car.

11. The gondola car pair of claim 10, said arcuate-shaped panel means comprising:

a first arcuate-shaped panel rigidly affixed to said first sidewall of said first gondola car, said first panel having a height from said floor corresponding to the height of said first sidewall; and a second arcuate-shaped panel rigidly affixed to said second sidewall of said first gondola car, said second panel having a height from said floor corresponding to the height of said second sidewall, said first and second arcuate-shaped panels in sliding rotational relationship to said first and second walls of said second gondola car.

12. The gondola car pairs of claim 11, said first and second walls of said second gondola car having a curved guide section in close relation to said first and second arcuate-shaped panels.

13. The gondola car pair of claim 11, said bridge extension having side edges having a shape matching the curvature of said first and second arcuate-shaped panels, said bridge extension having a width greater than a width of said central runway.

14. The gondola car pair of claim 13, said side edges of said bridge extension rigidly affixed to the bottom edge of said first and second arcuate-shaped panels.

15. The gondola car pair of claim 8, said floor of said first and second gondola cars having a plurality of cleat-receiving apertures extending therethrough, said cleat-receiving apertures extending through the upper surface of said floor.

16. The gondola car pair of claim 15, said cleat-receiving apertures extending through the thickness of said floor, each of said apertures having a cover affixed over said apertures on the bottom side of said floor.

17. The gondola car pair of claim 10, each of said sidewalls being angled at more than fifteen degrees from the vertical.

* * * * *